United States Patent [19]

Karlin

[11] Patent Number: 5,037,228

[45] Date of Patent: Aug. 6, 1991

[54] SINGLE PIECE FILE CLASP

[75] Inventor: James H. Karlin, Fairport, N.Y.

[73] Assignee: Casual Directions, Inc., Fairport, N.Y.

[21] Appl. No.: 547,515

[22] Filed: Jul. 2, 1990

[51] Int. Cl.[5] ..... B42D 13/10

[52] U.S. Cl. ..... 402/13; 402/80 P; 402/80 R; 402/62

[58] Field of Search ..... 102/13, 80 P, 80 R, 102/62, 63, 3, 17, 19, 20, 61; 283/75

[56] References Cited

U.S. PATENT DOCUMENTS

| | | | |
|---|---|---|---|
| 1,238,410 | 8/1917 | Landsberg et al. | 402/20 |
| 2,127,498 | 8/1938 | Westphal | 402/17 |
| 2,749,589 | 6/1956 | Carman, Jr. | 402/17 |
| 3,074,133 | 1/1963 | Jones | 24/67 R |
| 3,087,498 | 4/1963 | Vogel | 402/61 X |
| 4,270,247 | 6/1981 | Freedom | 24/30.5 R |
| 4,294,469 | 10/1981 | Errichiello | 402/80 P X |
| 4,305,675 | 12/1981 | Jacinto | 402/63 X |
| 4,305,675 | 12/1981 | Jacinto | 402/62 X |
| 4,386,795 | 6/1983 | Charles et al. | 283/75 |
| 4,397,577 | 8/1983 | Bauer | 402/19 |
| 4,657,422 | 4/1987 | Underwood | 402/61 |
| 4,932,804 | 6/1990 | Richards | 402/20 X |

FOREIGN PATENT DOCUMENTS

| | | | |
|---|---|---|---|
| 2206662 | 7/1978 | Fed. Rep. of Germany | 402/80 P |
| 73145 | 9/1960 | France | 402/80 P |
| 196426 | 4/1923 | United Kingdom | 402/63 |
| 943446 | 12/1963 | United Kingdom | 402/13 |

*Primary Examiner*—Paul A. Bell

*Attorney, Agent, or Firm*—Eugene Stephens & Associates

[57] ABSTRACT

A single piece file clasp, molded from a resin material, includes a main body portion and two prong portions extending from opposite ends of the main body portion. A series of equally spaced holes are molded in one of the prong portions and at least one post is molded in the other prong portion. The post is molded with a knob at its end which is dimensioned to provide a snap-fit engagement with any one of the holes to secure the prong portions together at varying amounts of overlap between them.

4 Claims, 1 Drawing Sheet

SINGLE PIECE FILE CLASP

BACKGROUND

File clasps have been used for a long time to secure papers in files. Typically, the file clasps secure papers to a mounting flap of the folders through a pair of holes that are punched in the papers and mounting flap. Two types of file clasps are in widespread use. Both types include a thin metal band having a main body portion and two prong portions extending on either side of the main body portion. The prong portions are relatively inelastic but bendable—first, to positions at right angles to the main body portion for inserting the prongs through the holes in the papers and mounting flap; and second, to parallel positions with respect to the main body portion for securing the papers to the flap. The main body portion is made larger than the prong portions to provide a relatively rigid body from which the prong portions may be bent.

The main difference between the two widely used file clasps is that one uses a brace element which fits over the prongs before they are bent in place, and the other does not. The brace element is shaped similar to the main body portion and includes openings for receiving the prong portions. The brace is inserted over the prong portions when the prong portions are first bent at right angles. The prong portions are then bent again at right angles into alignment with the brace and are inserted through a pair of keepers carried on the brace to secure the prongs to the brace. The other known file clasp simply provides for bending the prong portions against the top surface of the papers.

The metal clasps are subject to having sharp edges or burrs which can cut into the papers they are securing or cause cuts in fingers handling the clasps. The prongs also tend to become rippled or misshapen with repeated use and no longer tightly secure the paper to the file.

U.S. Pat. No. 3,074,133 to J. L. Jones discloses a plastic file clasp having prong portions that are attached to each other by a pressure-sensitive adhesive. The adhesive material is secured to the plastic prong portions and a release coating on a flexible backing piece is used to protect the adhesive prior to use. The backing pieces with release coatings are removed prior to securing the prong portions together. Although the fastener is intended to be reusable, the adhesive bond is expected to deteriorate with repeated use until the prong portions no longer adequately secure papers in the file.

SUMMARY OF THE INVENTION

My invention overcomes the problems of prior metallic and plastic file clasps by providing a new file clasp design made from an integral resin strap that is safe and convenient to use and that may be adjusted or reused without any significant loss in its ability to secure papers in a file.

My clasp includes the usual features of a main body portion and two prong portions which are joined to opposite ends of the main body portion. However, one of the prong portions is formed with a series of holes along its length, and the other prong portion includes at least one post having a knob or other type of protuberance formed at its end. The knob is dimensioned to provide a snap-fit engagement with any one of the holes in the other prong portion for fastening the prong portions together at varying amounts of overlap between them. The resin material surrounding the holes is sufficiently elastic to enable the knob, having a cross-sectional diameter slightly larger than the diameter of the holes, to be pressed through the holes into the snap-fit engagement. Both prong portions may be provided with a series of scallops that are formed along their respective lengths for increasing the flexibility of the prongs to be moved together into overlapping positions.

Preferably, three or more posts are provided along the length of the other prong portion so that at least two posts are used to fasten the prong portions together and so that a third post similarly fastens any unused length of the one prong portion which extends significantly beyond the first two posts. Accordingly, the distance between the second and third posts may be greater than the distance between the first two posts. Also, when more than one post is used, it is important that the holes in the one prong portion are evenly spaced and that the posts are spaced apart by even increments of the spacing between the holes so that the prong portions may be fastened together by the posts at varying amounts of overlap between them.

The knob portions of the posts are also specially dimensioned with respect to the holes in the one prong portion to reduce the height of the posts. For example, the vertical profile of the knob is defined by a radius of curvature that is smaller than the horizontal cross-sectional radius of the knob (i.e., one-half of the above-mentioned cross-sectional diameter of the knob). The holes are also countersunk to better conform one end of the holes with the profile portion of the knob when positioned together in snap-fit engagement. This arrangement limits the amount that the knob projects above the one prong portion when the two prong portions are snapped together.

My file clasp is molded from a single piece of resin material such as a high density polyethylene material. The edges of the mold which form the outline of my clasp may be radiused to remove any sharp corners of the clasp and make handling of my clasp much safer. Although only a single piece of resin material is used, my file clasp provides for locking papers together in a file and for adjusting the locking positions of my file clasp through a range of positions corresponding to the usual numbers of papers that may be added to a file. Of course, my file clasp may also be used to bind the same numbers of papers together within or without a separate file folder. Also, since the one piece design is molded of resin, it is possible to make the main body portion of increased thickness to provide extra rigidity for that portion. A recess may be molded into the main body portion for mounting a label, or the main body may be custom molded in the form of a logo. The color of the resin material may also be varied for custom matching the logo or for purposes of file coding.

DRAWINGS

DETAILED DESCRIPTION

Figures 1, 2, 3, 4, 5:
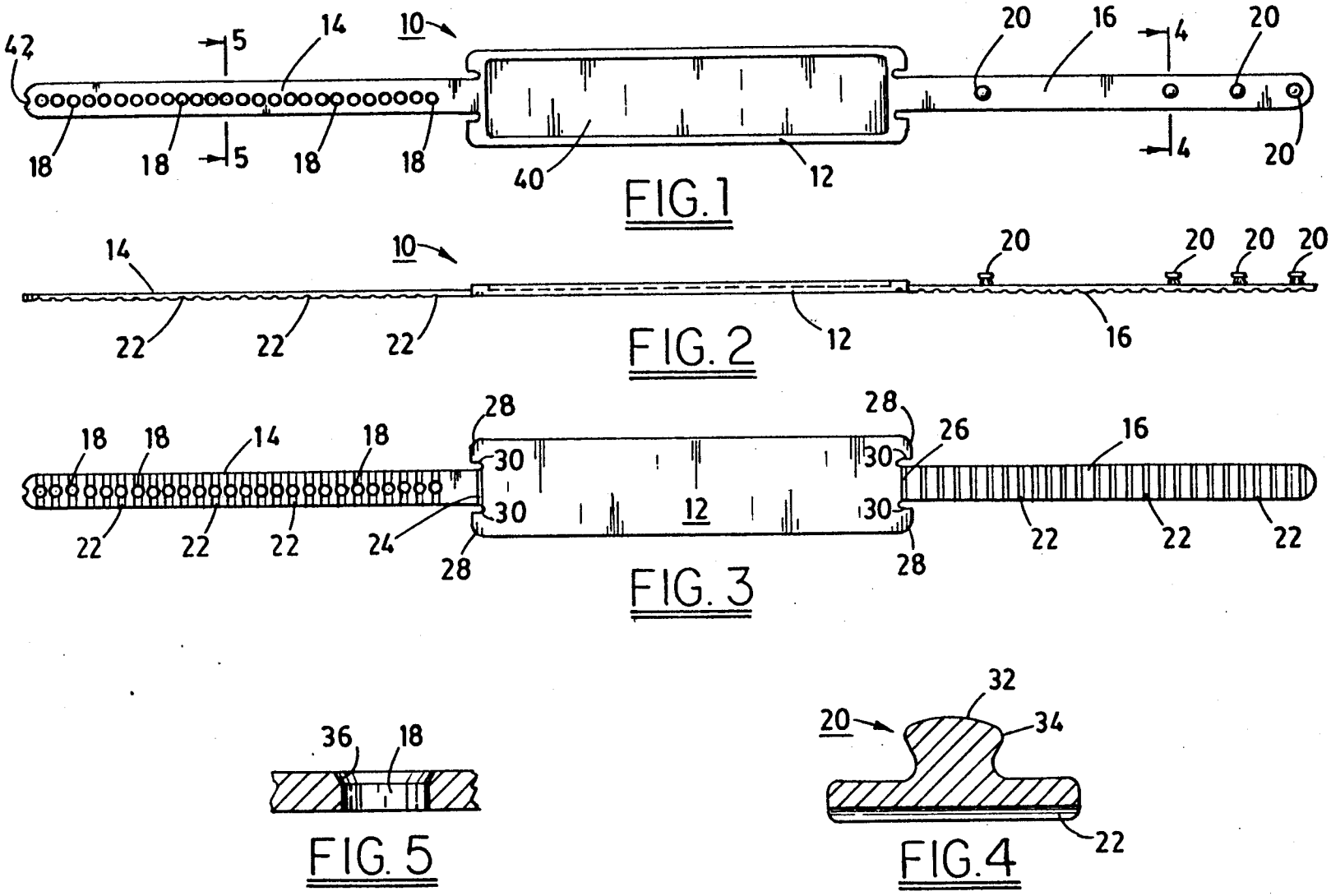
FIG. 1 is a top view of my preferred file clasp.
FIG. 2 is a side view of the same clasp.
FIG. 3 is a bottom view of the same clasp.
FIG. 4 is a greatly enlarged cross-sectional view taken through line 4—4 shown in FIG. 1.
FIG. 5 is a similarly enlarged cross-sectional view taken through line 5—5 of FIG. 1.

My file clasp 10 includes a main body portion 12 and two prong portions 14 and 16 which extend from either side of the main body portion. As seen best from FIG. 2, main body portion 12 is molded in a thicker section than prong portions 14 and 16. Prong portion 14 is molded with a series of equally spaced holes 18 along its length. The other prong portion 16 includes a plurality of posts 20 which are spaced at a predetermined number of equal increments of the spacing between holes 18. The integer spacing of the posts permits the post to be aligned with different groups of holes formed along the length of prong 14.

A series of scallops 22 are formed in the bottom surfaces of both prong portions. The scallops 22 are oriented perpendicular to the length of the prong portions for increasing the flexibility of the prong portions to be moved together into overlapping positions. The scallops 22 are also aligned with holes 18 to provide nearly equal flexibility between the prong portions. Scallops 24 and 26, closest to the main body portion 12, define respective hinges for bending the prongs 14 and 16 at right angles to the main body portion.

Main body portion 12 includes portions 28 that extend the length of the main body portion beyond the hinges 24 and 26. Relief grooves 30 separate the hinges 24 and 26 from the extended portions 28 on either side. The extended portions 28 together with relief grooves 30 encourage the main body portion to lay flat against the papers being secured when the prong portions 14 and 16 are bent at right angles to the main body portion about hinges 24 and 26. The extended portions 28 also bridge across respective diameters of mounting holes formed in the papers to resist tearing of the holes.

A greatly enlarged cross-sectional view of one of the mounting posts 20 is shown in FIG. 4. The post 20 includes a knob 32 that is defined by a vertical profile 34 having a much smaller radius of curvature than the horizontal cross-sectional radius of the knob. This feature lowers the profile aspect of the post 20.

A similarly enlarged cross-sectional view of one of the holes 18 is shown in FIG. 4. As seen in that figure, the holes 18 are countersunk within a recess 36. The recess is formed in the top surface of prong 14 and conforms with the outer profile 34 of posts 20 so that the posts may be fitted through holes 18 into a snap-fit engagement with little or no significant length of the posts extending through the top portion of prong 14.

The spacing between the posts 20 may be selected so that at least two posts are used to fasten the prong portions together into respective snap-fit engagements. Other of the posts are spaced apart at a larger distance to limit the amount that any unused length of prong portion 14 extends beyond the engagement of any one post. In other words, the other posts are used to "tie down" unused length of prong portion 14. Also, the end of prong 14 includes a recessed portion 42 that is shaped to provide clearance when abutted against one of the posts 20.

The main body portion 12 may also include a recessed portion 40 for mounting a label or other file information on the top of the clasp. Alternatively, a logo may be molded into the space at 40. Further, the entire file clasp 10 can be molded in a variety of colors for coding the subject of materials that are secured by my clasp.

My file clasp may be used by bending the prong portions 14 and 16 about hinges 24 and 26 into right angle positions with respect to main body portion 12. The prong portions 14 and 16 are then inserted through holes formed in the papers to be secured in a file, thereby moving main body portion 12 into contact with the papers. The prong portions 14 and 16 are then bent again to parallel positions with respect to the main body portion for moving the prongs into an overlapping relationship. One or more of the posts 20 are then aligned with one or more of the holes 18 and are pressed into a snap-fit engagement with the holes.

My file clasp may be released and readjusted to hold more or less papers by pulling the prong portions apart and aligning the one or more posts with different holes in the prong portion 14. The prong portions 14 and 16 easily bend about the scallops formed along their length, and the prongs may be bent about different of the scallops without forming a permanent fold in the prong portions which would interfere with the ability of the clasp to tightly secure papers.

Although my clasp has been shown with round knob-like protuberances formed at the outer ends of the posts 20, it may be appreciated that other shapes including square or hexagonal protuberances would also work by forming similarly shaped holes in prong portion 14. However, it is preferred that the protuberance narrows at least a little in cross-sectional dimension toward the outer end of the post to guide the post through the holes 18.

I claim:

1. A releasable clasp for securing papers in a file comprising:

a. an integral plastic strap having formed therein a main body portion and two flexible prong portions joined to opposite ends of said body portion by respective hinges formed in said strap;

b. one of said prong portions having a series of holes formed therein along its length and the other of said prong portions having at least one post that includes a protuberance formed at one end thereof;

c. said protuberance is dimensioned to provide a snap-fit engagement with different ones of said holes for securing said prong portions together at varying amounts of overlap between them;

d. said protuberance is formed as a knob having a cross-sectional diameter that slightly exceeds respective cross-sectional diameters of said holes; and e. said knob includes a vertical profile defined by a radius of curvature that is smaller than one-half of said cross-sectional diameter of the knob.

2. The clasp of claim 1 wherein said holes are countersunk to better conform with said vertical profile of the knob when positioned in snap-fit engagement with said knob.

3. A file clasp for joining papers together through a pair of holes formed through the papers comprising:

a. an integral strap molded from a resin material and having a main body portion and respective prong portions that extend from opposite ends of said main body portion;

means molded in said resin material for increasing flexibility of said prong portions for movement with respect to said main body s rtion into overlapping positions;

c. means molded in said resin for joining overlapping portions of said prongs together in a snap-fit engagement;

d. said means for joining said overlapping portions includes a series of holes molded along the length of one of said prong portions and at least one post molded on the other of said prong portions;

e. a protuberance is molded at one end of said post as a knob having a cross-sectional diameter slightly greater than respective cross-sectional diameters of said holes; and f. said knob is molded to include a vertical profile defined by a radius of curvature that is smaller than one-half of said cross-sectional diameter of said knob.

4. The file clasp of claim 3 wherein said holes are countersunk to better conform one end of said holes with said vertical profile of the knob when positioned in snap-fit engagement with said knob.

* * * * *